US009351596B2

(12) United States Patent
Karam

(10) Patent No.: US 9,351,596 B2
(45) Date of Patent: May 31, 2016

(54) DISPOSABLE BEVERAGE CONTAINER

(71) Applicant: TMA CAPITAL AUSTRALIA PTY LTD, Granville (AU)

(72) Inventor: Carl Karam, Granville (AU)

(73) Assignee: TMA CAPITAL AUSTRALIA PTY LTD, Granville, NSW (AU)

( * ) Notice: Subject to any disclaimer, the term of this patent is extended or adjusted under 35 U.S.C. 154(b) by 0 days.

(21) Appl. No.: 14/247,447

(22) Filed: Apr. 8, 2014

(65) Prior Publication Data

US 2014/0203029 A1 Jul. 24, 2014

Related U.S. Application Data

(63) Continuation of application No. 11/771,527, filed on Jun. 29, 2007, now abandoned.

(51) Int. Cl.

| | |
|---|---|
| ***B65D 1/44*** | (2006.01) |
| ***A47G 19/22*** | (2006.01) |
| ***B65D 1/26*** | (2006.01) |
| ***B65D 1/40*** | (2006.01) |

(52) U.S. Cl.

CPC ..... *A47G 19/2205* (2013.01); *B65D 1/265* (2013.01); *B65D 1/40* (2013.01); *B65D 1/44* (2013.01)

(58) Field of Classification Search

CPC ..... B65D 81/3865; B65D 1/265; B65D 1/44; B65D 1/42; B65D 1/40; A47G 19/2205

USPC ..... 220/675, 670, 673, 672, 737; 215/382

See application file for complete search history.

(56) References Cited

U.S. PATENT DOCUMENTS

| | | | | |
|---|---|---|---|---|
| D198,139 | S | 5/1964 | Edwards | |
| 3,157,335 | A | 11/1964 | Maier | |
| 3,194,468 | A * | 7/1965 | Baron | 229/400 |
| 3,401,862 | A | 9/1968 | Wanderer | |
| 3,512,677 | A | 5/1970 | Kovac | |
| 5,908,127 | A * | 6/1999 | Weick et al. | 215/373 |
| 6,588,654 | B2 | 7/2003 | Nakashima | |
| D505,592 | S * | 5/2005 | Liu | D7/532 |
| D546,123 | S * | 7/2007 | Yelland | D7/509 |
| 2004/0118860 | A1 * | 6/2004 | Leopold et al. | 220/737 |

* cited by examiner

*Primary Examiner* — Stephen Castellano
(74) *Attorney, Agent, or Firm* — Polsinelli PC

(57) ABSTRACT

A disposable beverage cup is provided to be received by a cup holder having a cup engagement means associated with an opening of the cup holder. The beverage cup comprises a base, at least one sidewall extending upwardly from the base to define a cup opening, and at least one projection disposed substantially horizontally on an outer surface of the sidewall a predetermined height above the base, the projection extending a predetermined distance outwardly from the sidewall. The at least one projection is configured to engage with the cup holder cup engagement means to retain the cup in the cup holder such that the cup is twisted a predetermined angle about a longitudinal axis of the cup to release the cup projection from engagement with the cup holder engagement means. In an alternative embodiment, the projection can be replaced by at least one depression disposed substantially horizontally in an outer surface of the sidewall a predetermined height above the base, the depression extending a predetermined distance inwardly from the sidewall so that the at least one depression is configured to engage with the cup holder cup engagement means to retain the cup in the cup holder such that the cup is twisted a predetermined angle about a longitudinal axis of the cup to release the cup depression from engagement with the cup holder engagement means.

10 Claims, 9 Drawing Sheets

PLAN VIEW

FIG. 7.2

Prior Art

DISPOSABLE BEVERAGE CONTAINER

This application is a continuation of application Ser. No. 11/771,527 filed Jun. 29, 2007.

FIELD OF THE INVENTION

The invention relates to disposable beverage cups and, in particular, disposable beverage cups configured to be retained in a cup holder.

The invention has been developed primarily for use with the sale of beverages to consumers for consumption away from the point of sale and will be described hereinafter with reference to this application. However, it will be appreciated that the invention is not limited to this particular field of use.

BACKGROUND OF THE INVENTION

Take away coffee, tea, hot chocolate or other beverages, such as carbonated non-alcoholic drinks are regularly sold by street vendors or shops for a consumer to take the beverage away and consume it away from the point of sale. For example, on a given city block in the city of Sydney, Australia, it is typical to find coffee vendors in cafes or shops disposed usually on the ground floor of buildings, or dispensing carts or vans disposed on a street corner or adjacent an office building. Although cafes and some shops often provide a limited number of seats for consumers, it is customary for the consumers to purchase a coffee or other beverage from one of these vendors to be taken away and consumed elsewhere, for example, in an office or whilst in transit.

The vendors or coffee shops, for example, typically dispense a high number of take away beverages. Some vendors dispense sugar and other additives into the take away coffees whilst others leave it to the consumer. Typically, take away coffees are dispensed to consumers in paper or Styrofoam cup containers and lids are disposed over the top to prevent spillage and retain heat. Sometimes the lids include an aperture for drinking the coffee without removing the lid.

It is regularly known that some consumers will purchase take away coffees on behalf of one or more people often to save those other people the inconvenience of a trip to the coffee vendor. To assist a consumer in transporting two or more take away coffee containers whilst avoiding spillage, trays are often used. For example, such trays incorporate cup container holders having four apertures spaced apart in a plane. A most common form resembles a paper or fibreboard egg carton with only four apertures and the cups are simply received within the apertures and the cups can form an interference fit with a cup container to retain the cup in the holder. Such fibreboard egg carton-type holders can include a projection extending along the length of each aperture to more securely retain a cup. Unfortunately, as most coffee cups are not perfect cylinders but are tapered into a substantially cylindrical or frusto-conical form, it is not unusual for the consumer to angle the tray far enough to cause one or more cups to simply fall out in the course of normal carrying events, such as looking at traffic whilst walking, traversing stairs or driving a motor vehicle. In the latter case, it is normal to purchase take-away coffees, for example, from a drive-thru equipped retailer. As such, any container holders desirably firmly retain the cups against vehicle acceleration, deceleration and in cornering.

In another form of coffee cup holder, two spaced apart fibreboard sheets interconnected by flanges, or foldable side walls, are used. In such trays, the lower sheet is solid and the upper sheet contains four spaced apart apertures to each receive a cup. In use, the cup holder is unfolded by moving the upper apertured sheet of the holder away from the solid base sheet using the flanges or side walls as hinges. The cups are simply disposed in the apertures to sit on the base sheet. Unfortunately, small variations in the size of a coffee cup will cause the cup to not be retained circumferentially about the aperture so that the only retention mechanism is that the cup base is supported only on the base sheet of the holder. This disadvantageously results undesirable movement in transit or the cup to more easily fall out of the aperture.

In order to tackle this problem, foldable fingers or projections extending inwardly from the aperture were employed. These fingers or projections are configured to extend radially inwardly so as to reduce the initial diameter of the aperture and hence increase the range of cup sizes that can be received therethrough. As the cup size increases from the initial size of the aperture defined by the ends of the fingers or projections, insertion of the cup causes the fingers to hingedly move and to bend downwardly and outwardly in a hinging manner so as to increase the aperture size to correspond to the size of the coffee cup and maintain a weak interference type fit.

Unfortunately, as the fingers are bent downwardly, it is found that they can be moved in response to a tilting tray and the additional biasing force supplied by a cup on some fingers on one side of the aperture whilst the tray is under tilt reduces the strength of the holding ability of these fingers. Furthermore, once the fingers or projections have been moved to accommodate a disposable coffee cup, the fingers lose some of their resilience to return to be substantially planar with the top of the holder, which further reduces their strength in holding cups.

Whilst such tray like holders are used in such city locations, they are also known to be used at sporting events, for example. When a consumer at a sporting stadium purchases two or more beverages, which are often dispensed in paper or plastic cups with tapered sidewalls, holders as above are used to assist the consumer make their way to their seats without spillage. Environments such as sporting events or where crowds are gathered, can make it difficult to carry two or more coffees or cold beverages when, for example, stairs need to be negotiated or accidental bumping can occur. In these environments, the above trays do not always perform their functions of retaining disposable cups securely for transit from a vendor to a remote location for consumption.

GENESIS OF THE INVENTION

It is the genesis of the invention to provide a disposable beverage cup that can be securely held by a cup holder, or to at least provide a useful alternative.

SUMMARY OF THE INVENTION

According to a first aspect of the invention there is provided a beverage cup having a planar base, a substantially frusto-conical sidewall extending from said base, terminating in an opening having a rim, and being centred on a longitudinal axis for said cup; wherein said side wall has corrugations at least adjacent said base, said corrugations being formed from a plurality of projections and depressions each of which lies in a corresponding one of a plurality of substantially parallel planes which are either substantially parallel to said longitudinal axis or are all tilted to a like extent from being perpendicular to said longitudinal axis, said corrugations extending circumferentially at least partially around said side wall, being located at least adjacent said base, and being shaped to engage with a cup holding aperture of a cup holder and to disengage therefrom by twisting said cup about said longitudinal axis and by urging said cup away from said cup holder.

It can therefore be seen that there is provided a disposable beverage cup with a projection or a depression which is configured to engage with a cup holder sidewall or aperture or projection extending therein such that the cups are securely retained in the holders until a consumer twists a cup about its longitudinal axis so as to disengage it from the holder and allow it to be removed. Furthermore, it can be seen that this engagement allows the continued use of some conventional disposable beverage cup holders and allows them to operate in an improved functional capacity to more securely hold disposable beverage cups. The advantage provided by engagement of the depression or projection with the cup holder so that twisting of the cup by a relatively small amount to release it from the holder is hitherto unknown and the simple pushing of the cup into the holder and the subsequent twisting of the container to remove it is particularly advantageous.

BRIEF DESCRIPTION OF THE DRAWINGS

Preferred embodiments of the invention will now be described, by way of example only, with reference to the accompanying drawings in which.

DETAILED DESCRIPTION

Figure 2:
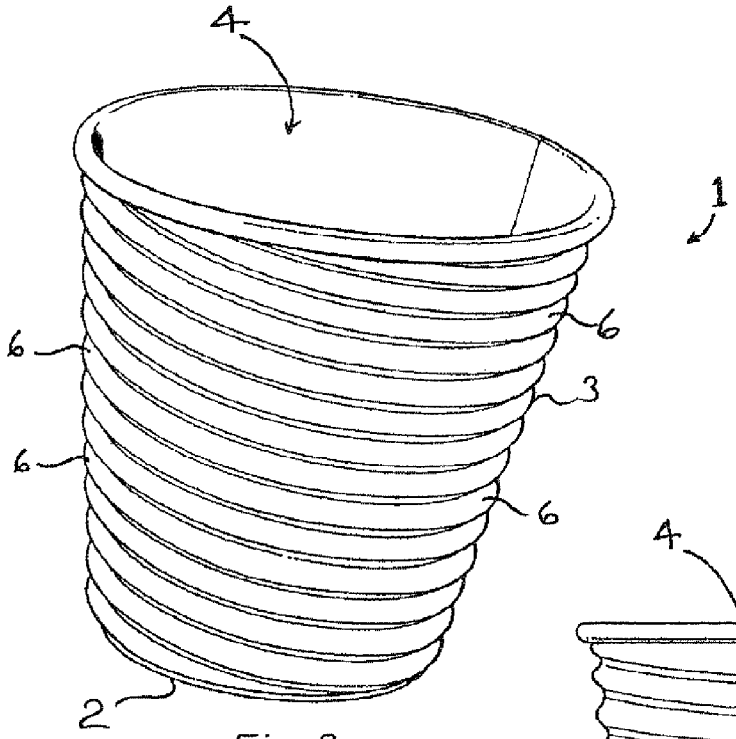
FIG. 2 is a perspective view of the cup of FIG. 1.

It will be appreciated that throughout the description of the preferred embodiments, like reference numerals are used to refer to like components.

Figure 1:
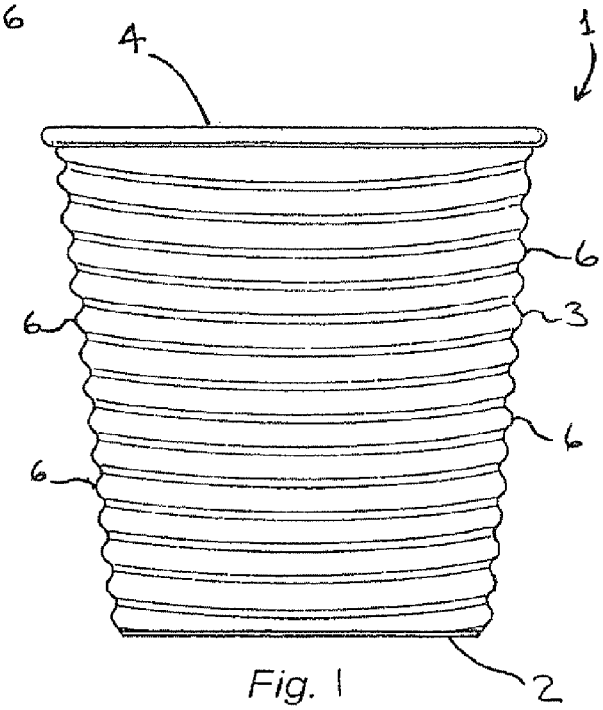
FIG. 1 is a front view of a disposable beverage cup according to a first preferred embodiment.
Figure 11:
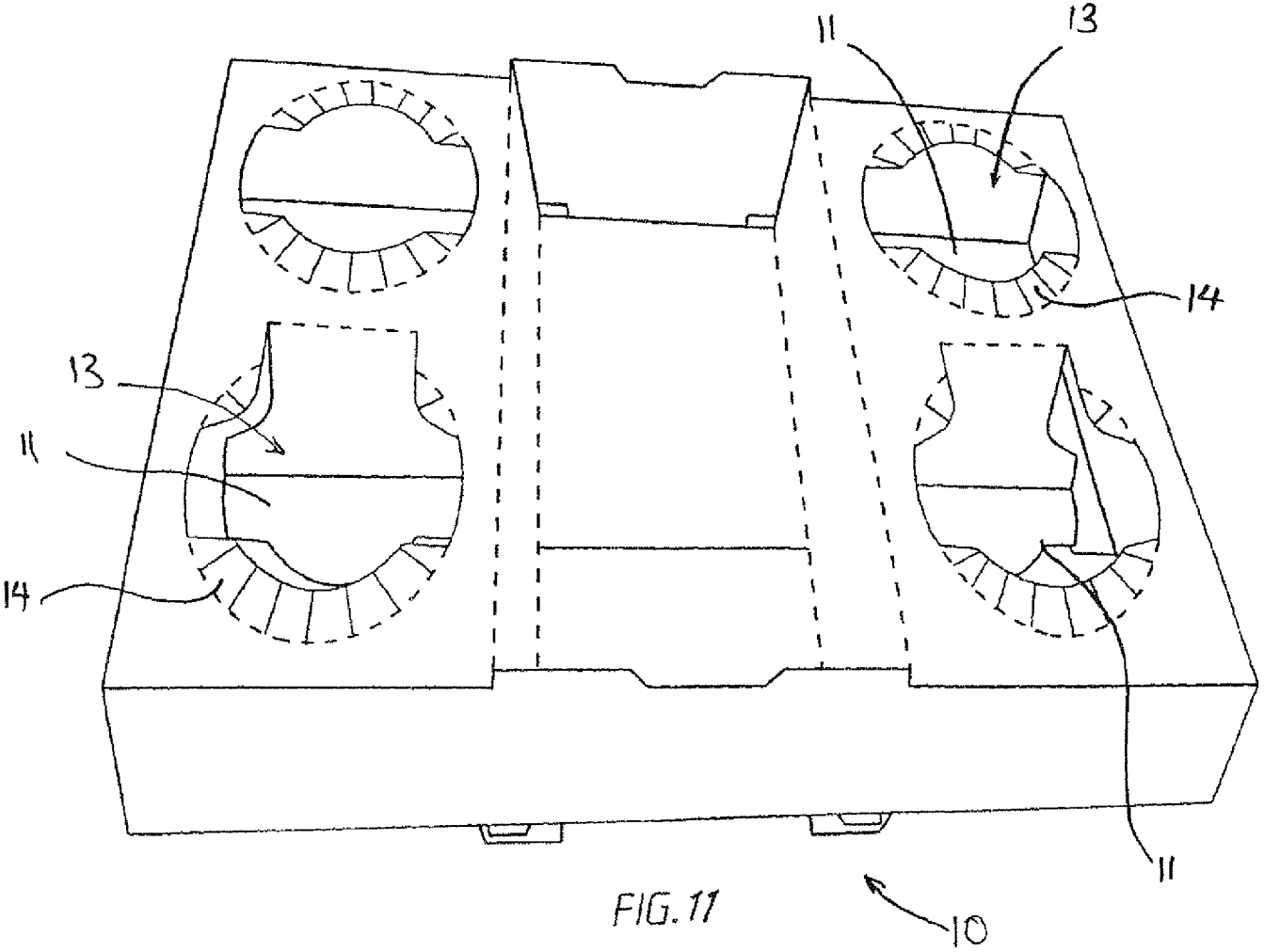
FIG. 11 Prior Art
FIG. 11 is a perspective view of a first prior art disposable beverage cup holder for use in retaining a disposable beverage cup according to any one of the embodiments of FIGS. 1 to 10.
Figure 12:
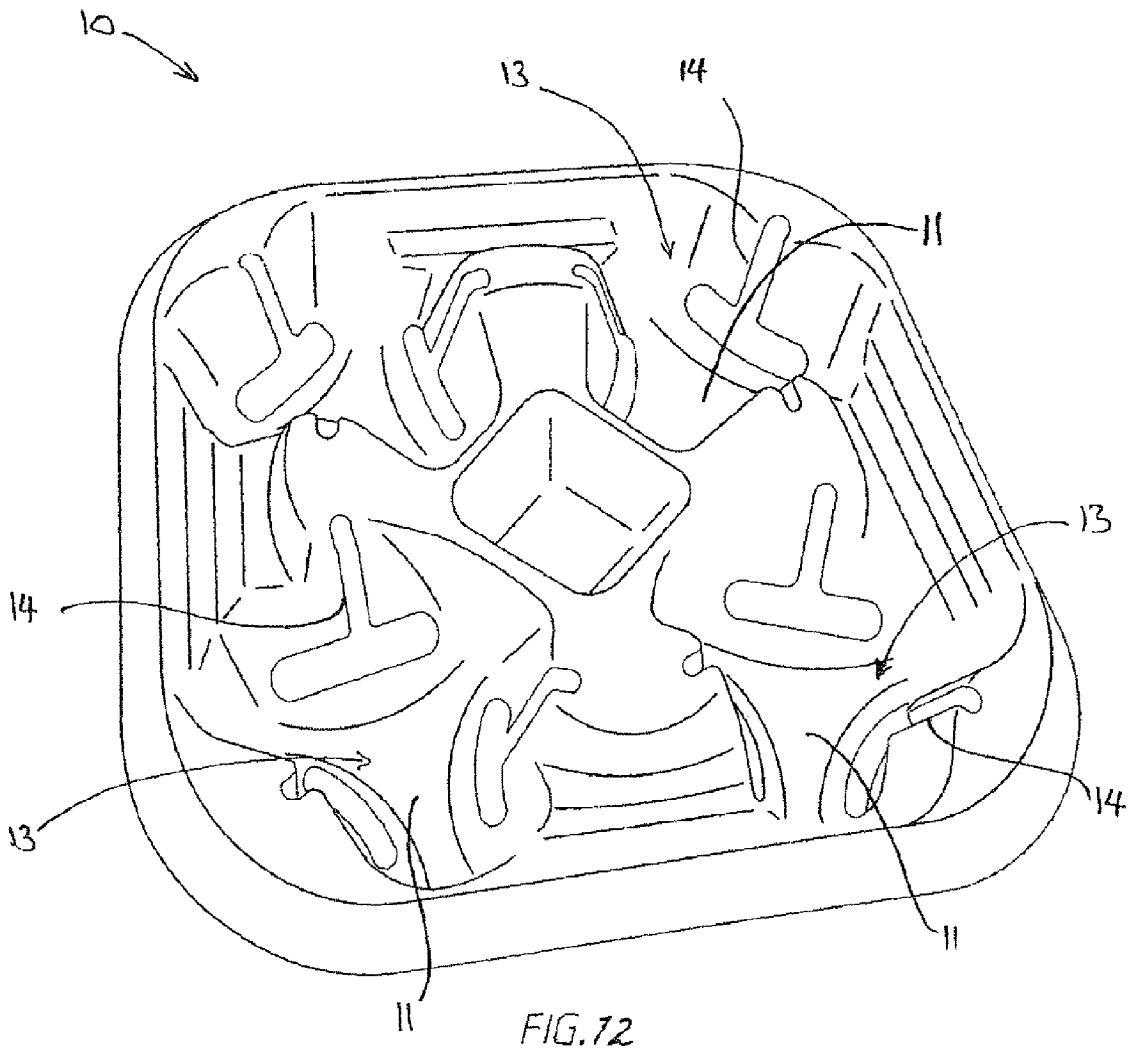
FIG. 12 is a perspective view of another prior art disposable beverage cup holder for use with the disposable beverage cups of FIGS. 1 and 2.

Referring to FIG. 1, there is shown a disposable beverage cup 1 configured to be received by a cup holder 10. The cup holder 10 includes an engagement means 14 associated with an opening 13 of the cup holder 10. Two prior art cup holders 10 are shown in FIGS. 11 and 12 respectively.

The beverage cup 1 includes a base 2 and a single side wall 3 upwardly extending from the base to define a beverage cup opening 4. The side wall 3 of the beverage container cup 1 is tapered to reduce from the beverage cup opening 4 down to the base 2. It will be appreciated that the side wall 3 can be straight and can be non-circular in cross-section or can be formed from two or more sidewall sub-components (not illustrated). Furthermore, it will be appreciated that the beverage cup container 1 can be formed from paper, fibreboard, Styrofoam, plastic or other common material. Yet further, the container 1 can be formed from a single or multiple layers to form, for example, cups 1 with a double wall.

A plurality of essentially horizontally extending projections 6 is disposed on the outer surface of the side wall 3. The substantially horizontally extending projections are longitudinally spaced apart along the side wall 3 of the beverage container 1. The projections 6 preferably extend a distance of at least half the wall thickness of the side wall 3 of the beverage container 1, however, this is not clearly seen in the drawings.

At least one, and preferably several, of the projections 6 on the sidewall 3 is/are configured to engage with the cup holder engagement means 14 so as to retain the cup in the cup holder in a secure manner.

In order to remove the beverage cup 1 from the cup holder 10 once the projection(s) 6 is/are engaged with the cup holder engagement means 14, the beverage cup 1 must be twisted by a predetermined angle, for example several degrees (eg 3 degrees) depending on the configuration of the depression/projection 6, in order to cause the projection 6 to become disengaged from the cup holder engagement means 14. In the embodiments shown in the drawings, the cup 1 is longitudinally twisted by an angle of between 5° and 40° to release it from engagement with holder engagement means 14. However, it will be appreciated that any preferred twisting angle from 2° or 3° to greater than 50° can be required to remove the cup 1.

To retain the beverage cup 1 in the cup holder 10, no twisting is necessary and the cup 1 is simply longitudinally slid or pushed into the cup holder 10 through the cup holder aperture 13.

Figure 4:
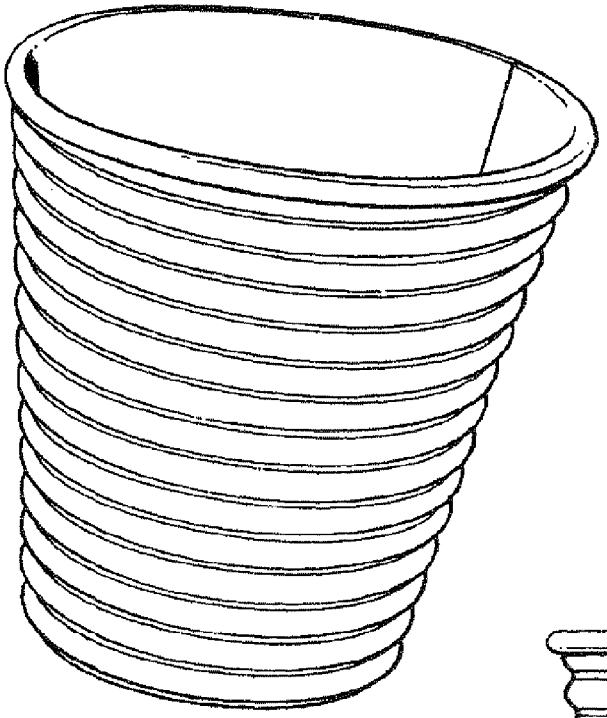
FIG. 4 is a perspective view of the cup of FIG. 3.
Figure 3:
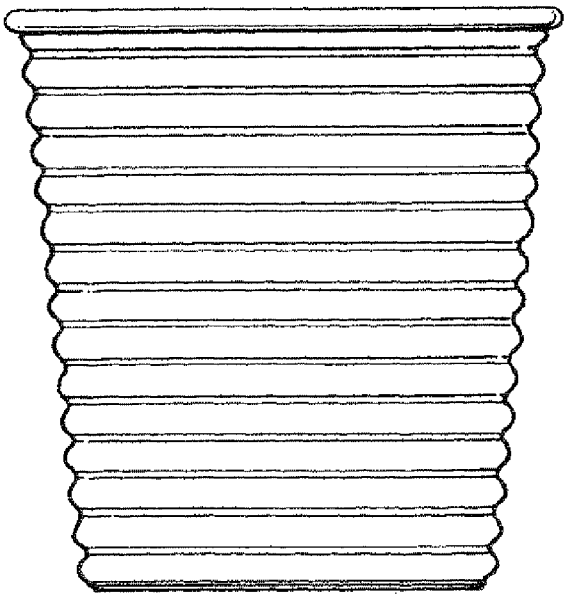
FIG. 3 is a front view of a disposable beverage cup according to a second preferred embodiment.
Figure 6:
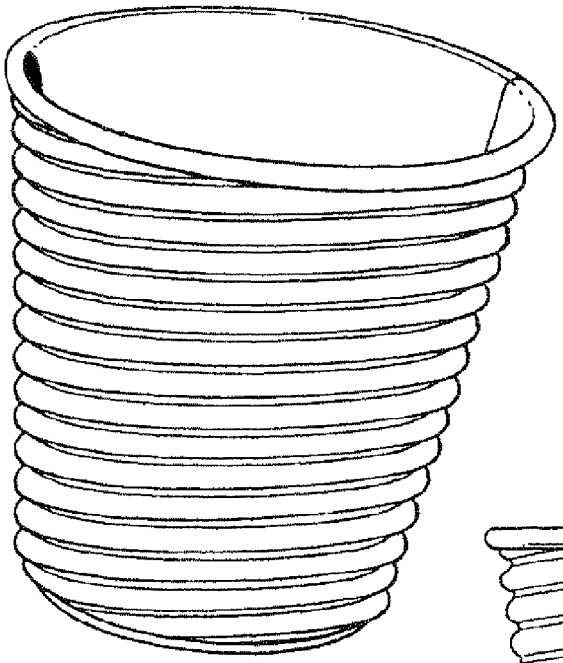
FIG. 6 is a perspective view of the cup of FIG. 5.
Figure 5:
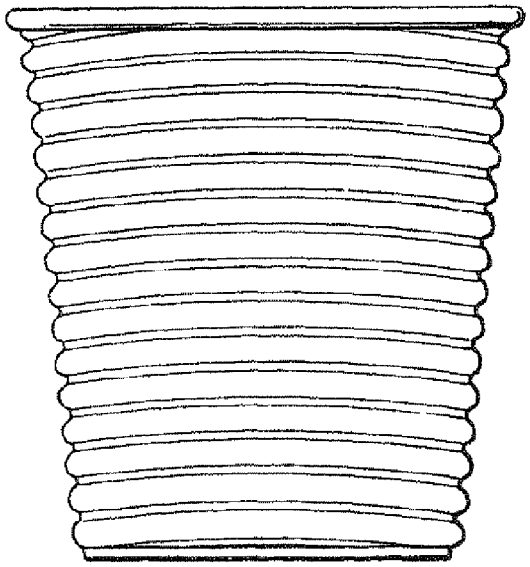
FIG. 5 is a front view of a beverage cup according to a third embodiment.

In the beverage cup 1 second embodiment of FIGS. 3 and 4, the projections are substantially straight horizontally across the sidewall 3. That is, each projection 6 lies in a plane which is substantially perpendicular to the longitudinal axis of the cup 1 In the third embodiment of FIGS. 5 and 6, the projections 6 are slightly curved in an opposite direction to the slight curvature of the projection of the beverage cup container 1 shown in the first embodiment of FIGS. 1 and 2. That is, the projections 6 in the first and third embodiments lie in a plane which is slightly inclined or tilted to the longitudinal axis of the cup 1. In the first embodiment of FIGS. 1 and 2, the projections 6 give the cup 1 the appearance of a smile, whereas in the third embodiment of FIGS. 5 and 6, the projections 6 give the cup 1 the appearance of a frown.

Figure 8:
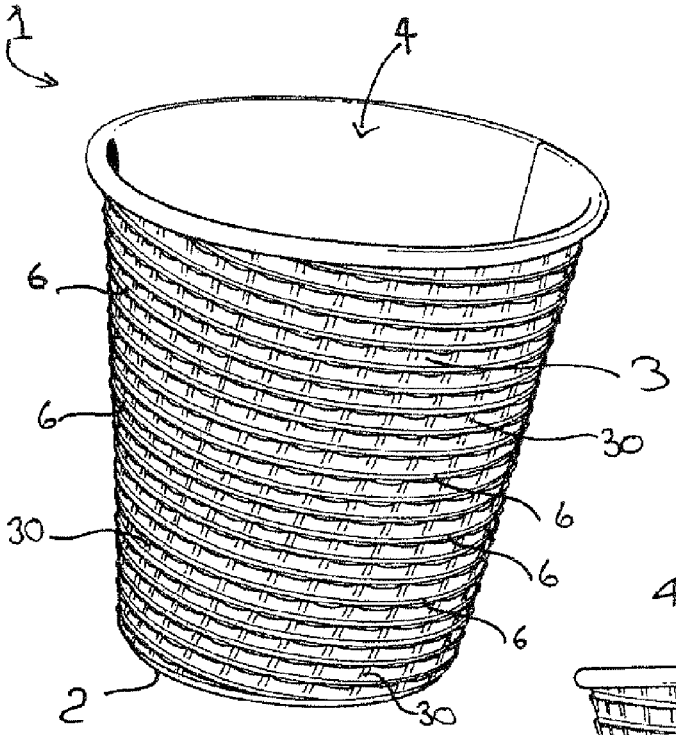
FIG. 8 is a perspective view of the cup of FIG. 7.
Figure 7:
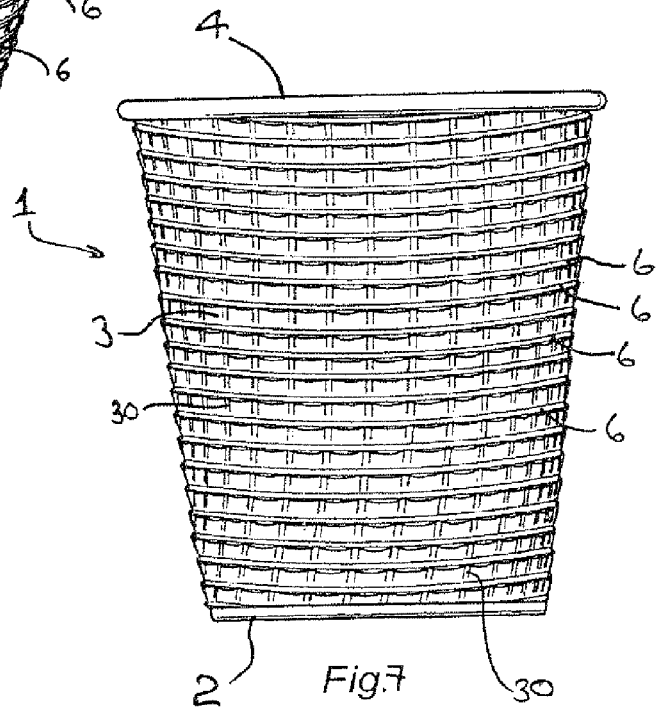
FIG. 7 is a front view of a beverage cup according to a fourth preferred embodiment.

FIGS. 7 and 8 show a fourth embodiment of a beverage cup 1 where the projections 6 are formed from folds. In this embodiment, the projections are not as prominent as the projections of the embodiments of FIGS. 1 to 6, however, it will be appreciated that the projections 6 are still configured to engage with cup holder engagement means 14 in the same way as the first three embodiments of FIGS. 1 to 6 so that the cup container 1 needs to be twisted to disengage it from the engagement means 14. It will be appreciated that in the fourth embodiment of FIGS. 7 and 8, the beverage cup 1 also includes substantially vertically extending projections 30 which are purely ornamental.

Figure 10:
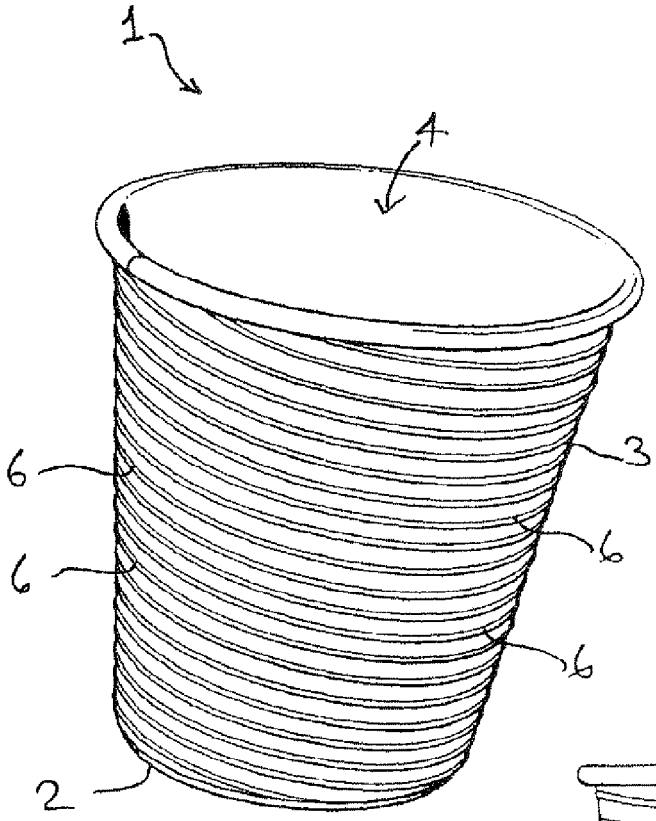
FIG. 10 is a perspective view of the cup of FIG. 9.
Figure 9:
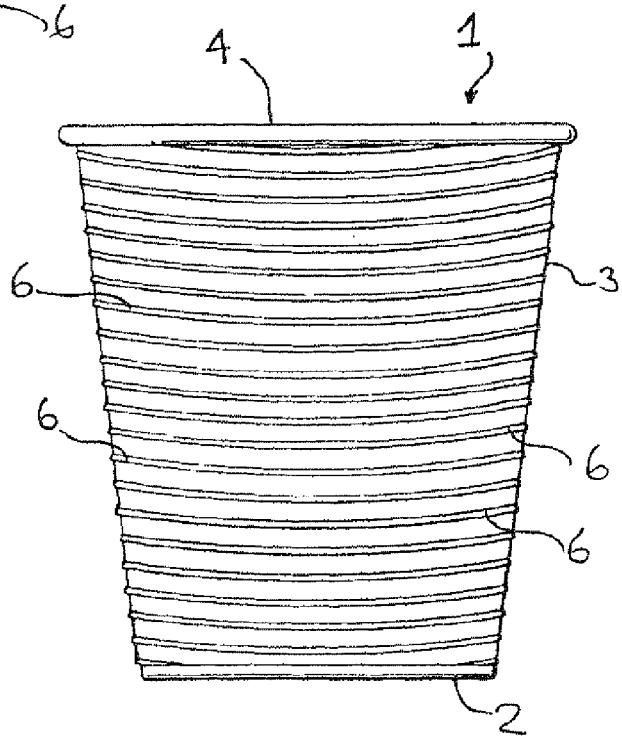
FIG. 9 is a front view of a beverage cup according to a fifth preferred embodiment.

FIGS. 9 and 10 show a beverage cup according to a fifth embodiment. This embodiment is similar to the beverage cup of the fourth embodiment shown in FIGS. 7 and 8 except that no vertical projections 30 are included on the outer sidewall 3.

Figure 13:
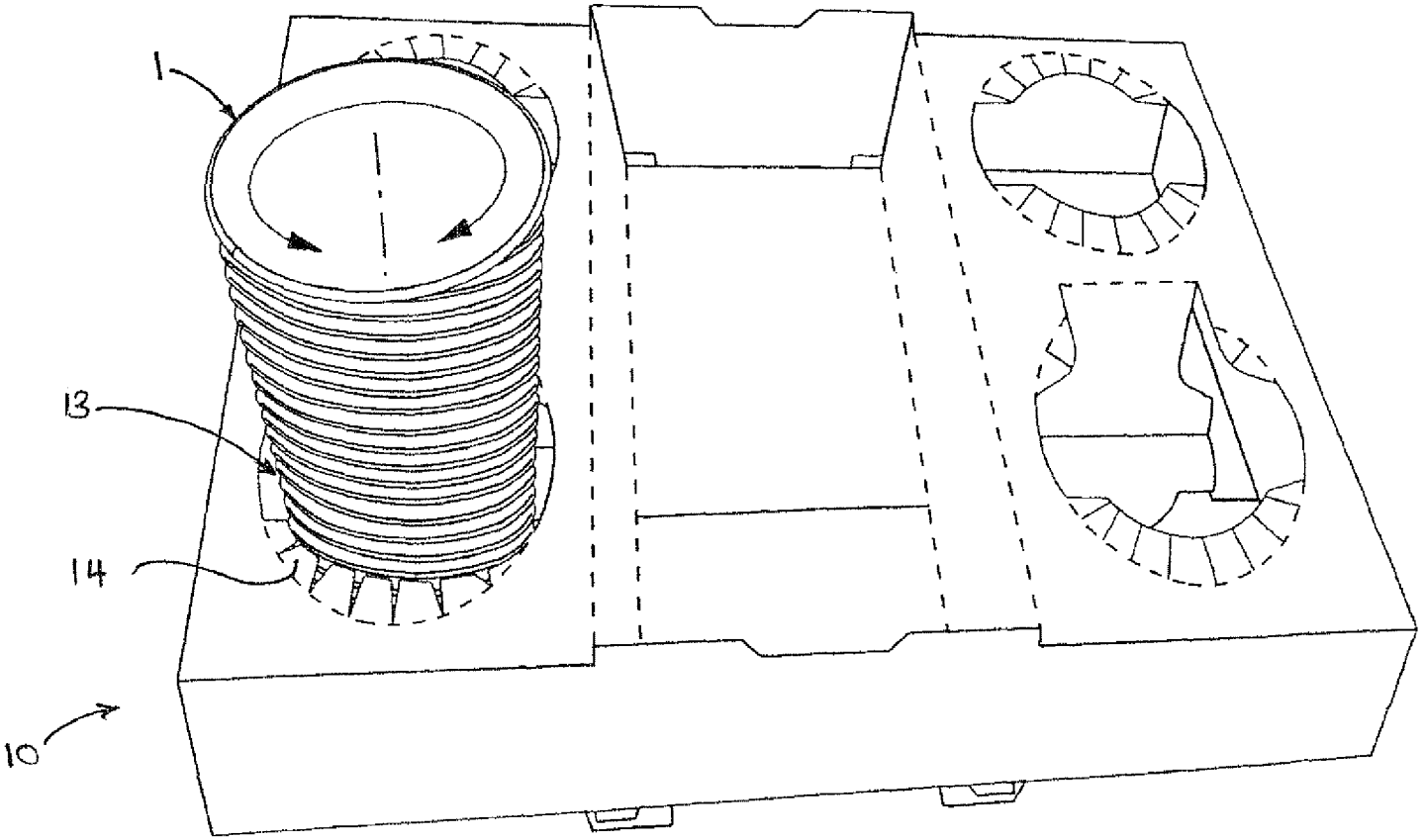
FIG. 13 is a perspective view of a beverage cup of FIGS. 9 and 10 showing the cup being twisted for removal from the holder of FIG. 11.
Figure 14:
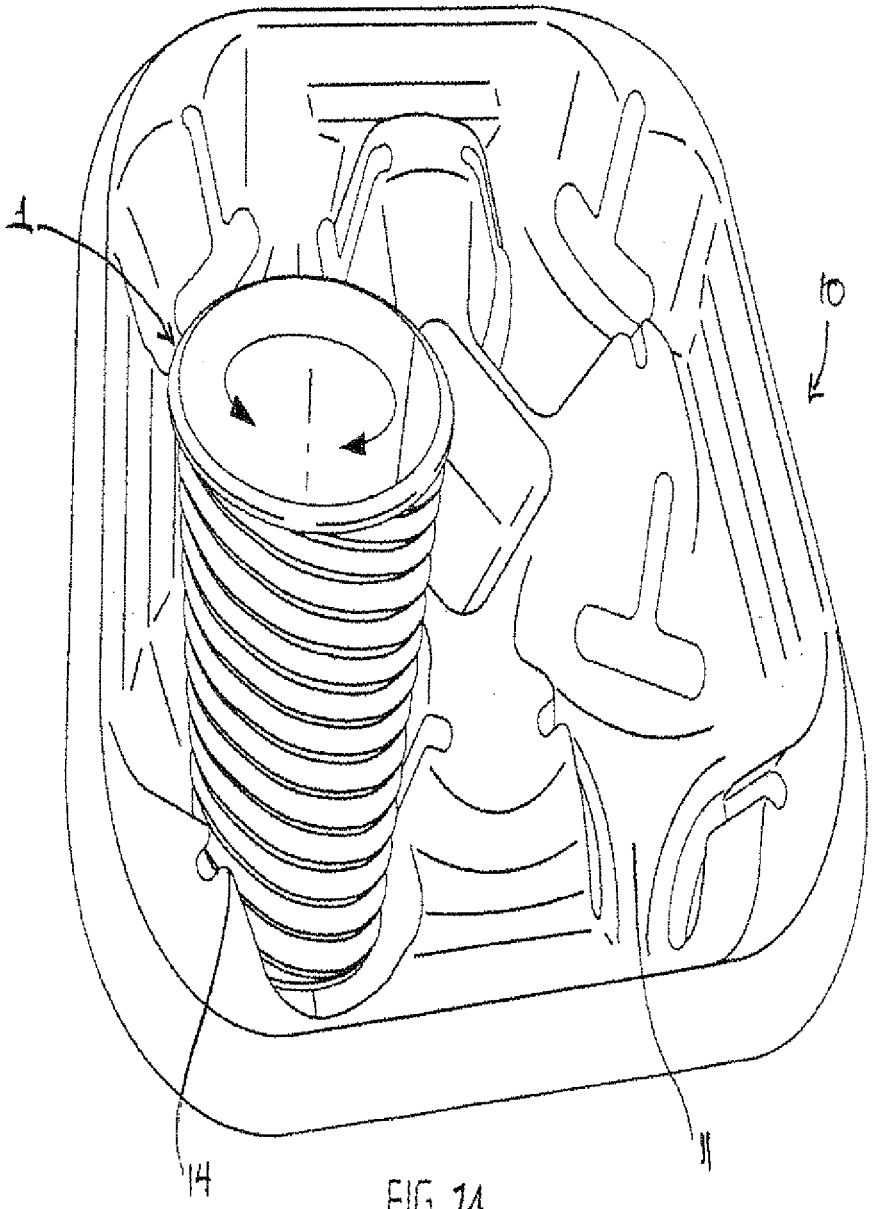
FIG. 14 is a perspective of a beverage cup of FIGS. 1 and 2 showing the cup being twisted for removal from the holder of FIG. 12.

Turning now to FIGS. 13 and 14, there is shown the insertion of a preferred beverage cup 1 into each of the cup holders 10 according to FIGS. 11 and 12 respectively. Upon insertion, a projection 6 of the beverage cup container 1 engages with the cup holder engagement means 14. This secures the beverage cup 1 within the cup holder 10.

In order to disengage the beverage cup 1 from the cup holder 10 to allow the beverage cup to be removed, the beverage cup 1 is rotated about a longitudinal axis of the beverage cup container 1 to mechanically disengage a projection 6 from the cup holder engagement means 14. It will be appreciated that the amount of twisting can vary between a mere few degrees (eg. 3 degrees) to several tens of degrees (eg. 30 degrees) depending on the particular cup holder engagement means 14 and the particular projection 6.

It will be appreciated that, if desired, the projections 6 on the beverage cup 1 can extend up from the base 2 only a predetermined height above the base 2 towards the beverage cup opening 4. In this way, the projections 6 will only need to be as high from the base 2 as the cup holder opening 13 is disposed above the cup holder base 11.

It will also be appreciated that the projections 6 can extend substantially fully circumferentially around the side wall 3 or about only part of the sidewall 3 (not illustrated). For example, the projections could extend around 90° of the 360° sidewall 3. In this way, only that potion of the cup holder engagement means 14 substantially facing the projection 6 will retainingly engage with the projection 6.

It will be appreciated that although the preferred embodiments of the disposable beverage cup 1 include a plurality of longitudinally spaced apart projections 6 each substantially horizontally extending along the sidewall 3, a minimum of only one projection 6 is required. However, a plurality are employed for aesthetic purposes, or are employed to ensure that the cup holder engagement means 14 can be engaged even if the means 14 is disposed at different heights above the cup holder base 11. It will be appreciated that although the preferred embodiments of the beverage cup 1 shown in FIGS. 1 to 10 include a plurality of longitudinally spaced projections 6 forming a corrugated surface of the sidewall 3, it will be appreciated that a single helically extending projection disposed on the outside of the sidewall 3 can also be used. In such embodiments, although not illustrated, it will be appreciated that the single helically wound projection could extend a predetermined distance around the sidewall 3 as well as having a pitch to ensure it extends up the sidewall 3 a predetermined distance.

Whilst the preferred embodiments of FIGS. 1 to 10 show a beverage cup 1 and projections 6 configured for engagement with a cup holder engagement means 14, it will be appreciated that the projections 6 can each be replaced with a depression 5 which also extends substantially horizontally around the sidewall 3 and extends inwardly a predetermined distance into the sidewall 3.

As with the preferred embodiments of FIGS. 1 to 10, the depression 5 is configured to engage with the cup holder engagement means 14. That is, the projection can be built up on the outside of the sidewall 3 of the cup container 1 to implicitly create depressions 5, or the depression 5 can be built into the sidewall 3 of the beverage cup container 1. The depression 5 can extend only a predetermined distance longitudinally up the sidewall 3, or it could extend substantially all or part of the way circumferentially around the sidewall 3. Although not illustrated, it is most preferred that the depression 5 extends a distance of at least a third of the thickness of the sidewall 3 thereinto.

The foregoing describes only preferred embodiments of the present invention and modifications, obvious to those skilled in the art, can be made thereto without departing from the scope f the present invention. For example, cup 1 can be tapered in the longitudinal direction as shown, or it can have straight (ie. truly cylindrical) sidewalls. The cup 1 can include both projections 6 and depressions 5 for engagement with a cup holder engagement means 14 as preferred. Furthermore, it will be appreciated that in the case of the corrugated sidewall 3 of the embodiment shown in FIG. 1, can be formed from longitudinally spaced apart and substantially horizontally extending depressions 5 so that the substantially horizontally extending projections 6 are artefacts thereof, or vice versa, where the depressions 5 are artefacts of the addition of projections 6. Further, it can be seen in the embodiment of FIG. 14 that a plurality of projections 6 can simultaneously engage with cup holder engagement means 14.

The term "comprising" (and its grammatical variations) as used herein is used in the inclusive sense of "including" or "having" and not in the exclusive sense of "consisting only of".

The invention claimed is:

1. A beverage cup having a planar base, a substantially frusto-conical sidewall extending and widening from said base, terminating in an opening having a rim, and being centred on a longitudinal axis for said cup;

wherein said sidewall has corrugations throughout the entirety of said sidewall, from said base to said opening, wherein said corrugations are formed from a plurality of projections and depressions and extend circumferentially around the entirety of said sidewall except where corrugations terminate at said base and said opening, wherein the entire outermost edge of each of the projections of the corrugations lie in a corresponding and different one of a plurality of straight, parallel, and non-intersecting planes that are tilted relative to said longitudinal axis, provided that the tilt is less than 90°, and wherein said corrugations are shaped to engage with a cup holding aperture of a cup holder and to disengage therefrom by twisting said cup about said longitudinal axis and by urging said cup away from said cup holder.

2. A cup as claimed in claim 1 wherein said substantially parallel planes are tilted upwardly.

3. A cup as claimed in claim 1 wherein said substantially parallel planes are tilted downwardly.

4. A cup according to claim 1 including decorative depressions and/or projections on said sidewall outer surface of said cup.

5. A cup according to claim 1 formed from paper, fibreboard, Styrofoam, or plastic.

6. An combination comprising:

(a) a beverage cup according to claim 1; and (b) a cup holder comprising an aperture for said beverage cup and an engaging means to hold said beverage cup within said aperture of said cup holder.

7. The combination of claim 6, wherein said corrugations engage with said engaging means upon entry of said cup into said aperture.

8. The combination of claim 7, wherein said beverage cup disengages from said engaging means by twisting said beverage cup about said longitudinal axis.

9. The combination of claim 8, wherein said beverage cup disengages from said engaging means by twisting said cup about said longitudinal axis by an angle of between 2° to 55°.

10. The combination according to claim 6, wherein said aperture is round.

* * * * *